United States Patent [19]

Hjalmarson

[11] 4,062,151

[45] Dec. 13, 1977

[54] BILLET GRINDING MACHINE

[75] Inventor: Sven Ingemar Hjalmarson, Fagersta, Sweden

[73] Assignee: Sunds Aktiebolag, Sundsvall, Sweden

[21] Appl. No.: 727,476

[22] Filed: Sept. 28, 1976

[30] Foreign Application Priority Data

| | | |
|---|---|---|
| Oct. 8, 1975 | Sweden | 7511294 |
| Aug. 11, 1976 | Sweden | 7608957 |

[51] Int. Cl.[2] ..... B24B 7/02

[52] U.S. Cl. ..... 51/34 D; 51/47; 51/165.9

[58] Field of Search ..... 51/34 D, 47, 45, 99, 51/126, 165.9

[56] References Cited

U.S. PATENT DOCUMENTS

| | | | |
|---|---|---|---|
| 2,308,843 | 1/1943 | Wilson | 51/165.9 X |
| 2,982,056 | 5/1961 | Edgvist | 51/165.9 X |
| 3,562,959 | 2/1971 | Dooley | 51/47 |
| 3,641,709 | 2/1972 | Gazuit | 51/47 X |
| 3,709,096 | 1/1973 | Robertz | 51/99 X |
| 3,721,045 | 3/1973 | Wojcik | 51/165.9 X |

FOREIGN PATENT DOCUMENTS

| | | | |
|---|---|---|---|
| 930,956 | 7/1973 | Canada | 51/165.9 |
| 1,220,285 | 6/1966 | Germany | 51/165.9 |

*Primary Examiner*—Gary L. Smith

*Attorney, Agent, or Firm*—Lerner, David, Littenberg & Samuel

[57] ABSTRACT

A grinding machine for grinding workpieces, such as ingots and billets, is provided which, in combination, includes a movable table for supporting the workpiece, a base arranged adjacent to the movable table, and a pair of arms pivotally mounted on the base. A holder supports a grinding wheel, and the holder is pivotally connected to the pair of arms at a pivot so that the contact force of the grinding wheel with the workpiece is caused by the turning moment of the holder about the pivot. A hydraulic cylinder is connected to the holder for pivoting the holder and the grinding wheel about the pivot so that the contact force of the grinding wheel may be balanced and controlled. In addition, the hydraulic cylinder is supported on a movable carriage and is connected to the pivot so that the hydraulic cylinder is movable with the holder and the grinding wheel as the holder moves about the pivot.

8 Claims, 6 Drawing Figures

BILLET GRINDING MACHINE

FIELD OF THE INVENTION

The present invention relates generally to billet-grinding machines and, more particularly, to an improved billet-grinding machine which provides a constant contact force between the grinding wheel and the billet so that a uniform removal of material from the billet during grinding is obtained.

BACKGROUND OF THE INVENTION

Typically, billet-grinding machines include a stand carrying a grinding wheel arranged adjacent to a table for the billet to be ground. The grinding wheel is mounted on a horizontal axle, which is driven by a motor, and the grinding wheel is movable in a vertical direction as well as in a horizontal direction across the workpiece. Typically, the grinding wheel is supported on the stand via a linkage so that it is movable in the vertical and horizontal directions. Usually, the table is capable of reciprocating in a horizontal plane and parallel with the axle of the grinding wheel.

The billets are ground so as to remove or eliminate cracks and the irregularities in the surface layer of the billet. Otherwise, these cracks and irregularities would substantially deteriorate the quality of further work performed on the billet. However, the material of the billet is expensive, and therefore, the grinding must be accurately controlled so as to minimize the amount of material removed from the surface of the billet. It is therefore advantageous to maintain the amount of material being removed constant. However, this requires that the contact force between the grinding wheel and the billet must be maintained constant during the horizontal movement of the grinding wheel. This objective can be achieved, for example, by directly maintaining constant the pressure in a hydraulic cylinder connected to the suspension arrangement of the grinding wheel or indirectly by controlling the pressure in the hydraulic cylinder by means of the power consumption of the motor driving the grinding wheel.

However, there have been drawbacks to both of these methods. In the former case, difficulties arise because the suspension of the grinding wheel is of such a nature that a constant pressure in the hydraulic cylinder produces a varying contact force between the billet and the grinding wheel as it moves. In the latter case, an extensive and complicated control apparatus is required for rendering a satisfactory result. A typical example of a prior art grinding machine is disclosed in U.S. Pat. No. 2,982,056.

Broadly, it is an object of the present invention to provide an improved grinding machine which overcomes one or more of the aforesaid problems. Specifically, it is within the contemplation of the present invention to provide a grinding machine which includes a hydraulic cylinder for determining the contact force with the billet and is arranged so that a constant hydraulic pressure corresponds directly to a constant contact force between the grinding wheel and the billet.

SUMMARY OF THE INVENTION

Briefly, in accordance with the principles of this invention, an improved grinding machine is provided which includes a movable table for supporting the workpiece to be ground, a base, and a pair of arms pivotally mounted on the base. A holder supports a grinding wheel for grinding the surface of the workpiece, and the holder is pivotally connected to the pair of arms at a pivot so that the contact force of the grinding wheel with the workpiece is caused by the turning moment of the holder about the pivot. A hydraulic cylinder is connected to the holder for pivoting the holder and the grinding wheel about the pivot for counterbalancing the weight of the holder and the grinding wheel so as to control the contact force of the grinding wheel with the workpiece. In addition, carriage means are provided for movably supporting the hydraulic cylinder, and such means are connected to the pivot so that the hydraulic cylinder is movable with the holder and the grinding wheel as they move about the pivot.

Advantageously, as a result of the present invention, the contact force of the grinding wheel with the workpiece is determined directly by the pressure in the hydraulic cylinder. Therefore, by maintaining the pressure in the hydraulic cylinder constant, material is removed from the billet uniformly during the grinding process, irrespective of the position of the grinding wheel relative to the workpiece-supporting table.

BRIEF DESCRIPTION OF THE DRAWINGS

Further objects, features, and advantages of the present invention will become apparent upon the consideration of the following detailed description of a presently-preferred embodiment when taken in conjunction with the accompanying drawing, wherein.

DETAILED DISCUSSION OF PREFERRED EMBODIMENTS OF THE INVENTION

Figure 1:
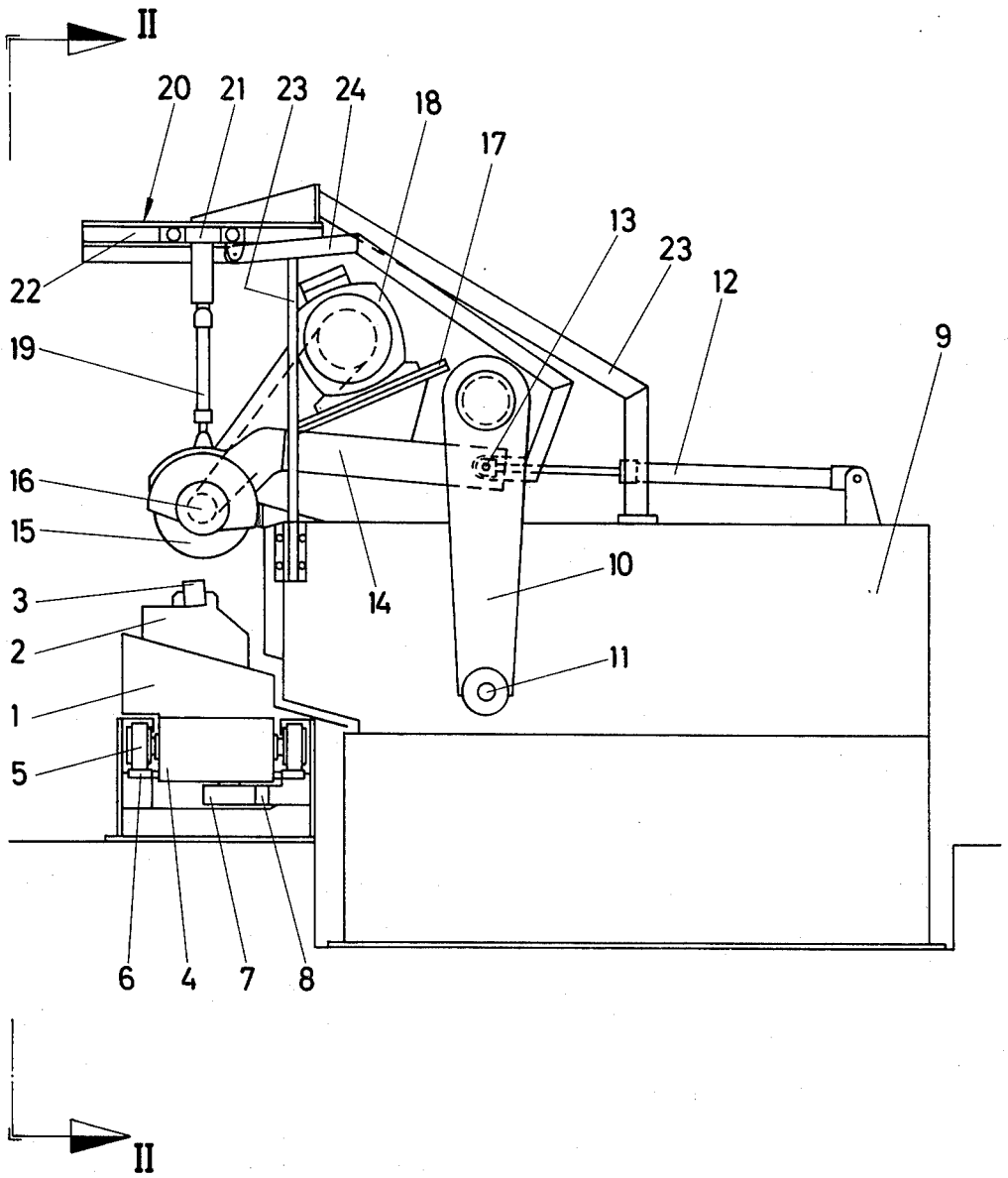
FIG. 1 is a side elevational view of a first embodiment of a billet-grinding machine employing the features of the present invention.

Referring now to FIG. 1, there is shown the improved billet-grinding machine of the present invention, which includes a table 1 movable along a horizontal path and provided with holding means 2 for supporting the billet 3 to be ground. The table 1 is mounted on a carriage 4 with wheels 5 running along rails 6. The table 1 is driven by means of a pinion 7, which meshes with a rack 8 so that the table 1 reciprocates along the horizontal path.

The grinding machine also includes a base or stand 9 pivotally supporting two arms 10, which are coupled together and pivotal about a horizontal axle 11 in the stand 9. The pivotal arms 10 extend upwardly in a substantially vertical direction from the stand 9 and are movable in an arc about axle 11 by action of a drive means 12 in the form of a hydraulic cylinder. The upper portion of pivotal arms 10 includes a pivot axis or joint 13 for pivotally supporting a holder 14. The holder 14 supports the axle 16 of a grinding wheel 15. A drive motor 18 for driving the axle 16 of the grinding wheel is mounted on a support plate 17 secured to the upper surface of holder 14. Preferably, motor 18 drives grinding wheel 15 through a suitable belt drive.

First Embodiment of the Invention

Figure 2:
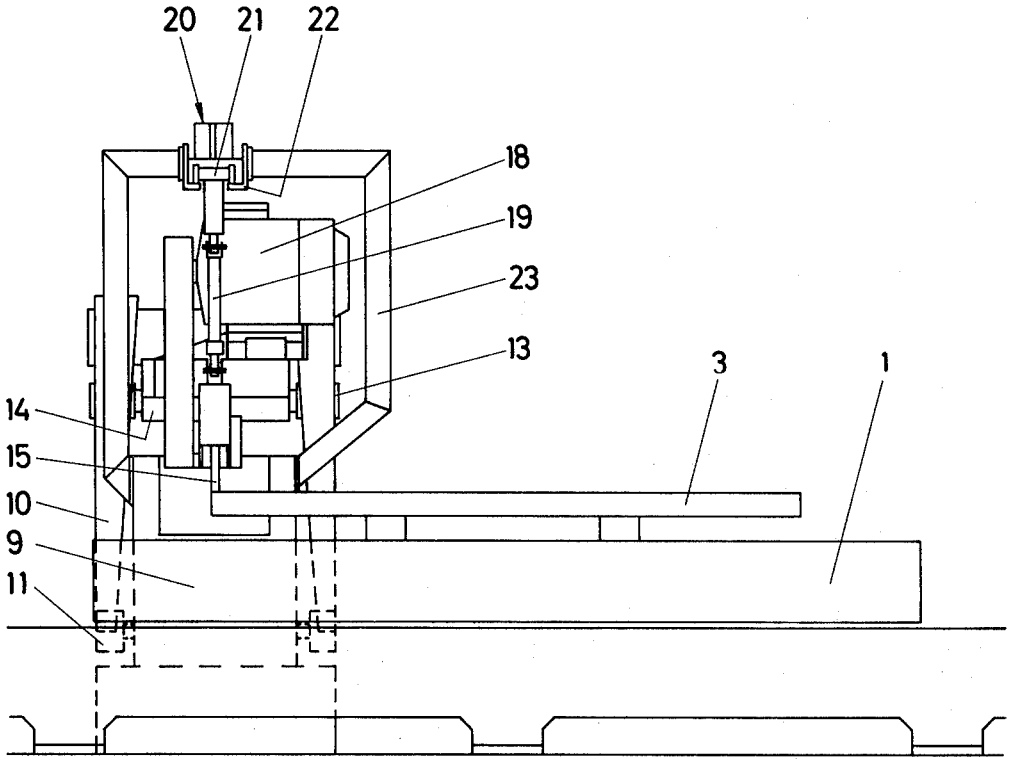
FIG. 2 illustrates the machine of FIG. 1 along Section II—II of FIG. 1.

FIGS. 1 and 2 illustrate the first embodiment of the present invention. In accordance with the present invention, the contact force of the grinding wheel 15 against billet 3 is determined by a hydraulic cylinder 19 located directly above grinding wheel 15.

In this embodiment, holder 14 is connected to a horizontal guide means 20 which is disposed along an axis perpendicular to the axle of the grinding wheel. The guide means 20 includes a carriage 21, which runs in horizontal tracks 22. The hydraulic cylinder 19 is pivotally connected to carriage 21, and tracks 22 are rigidly connected to stand 9 by means of frame element 23. In addition, a rigid coupling arm 24 is pivotally connected to carriage 21 and to pivotal arms 10 at pivot 13.

The operation of the grinding machine of this embodiment is as follows. Hydraulic cylinder 19 operates to move grinding wheel 15 into contact with billet 3 located on movable table 1. The table 1 is moved along rails 6 so that the billet is ground in its longitudinal direction. The pressure in hydraulic cylinder 19 is determined so that the load of the holder 14, including grinding wheel 15 and motor 18, is relieved to the extent desired. In this manner, the pressure in the hydraulic cylinder 19 controls the contact force between the grinding wheel and the billet. During the grinding process, during which the upper surface of billet 3 is ground, hydraulic cylinder 12 operates to pivot arms 10 and move grinding wheel 15 in a direction perpendicular to the direction of movement of table 1. Because coupling arm 24 joins carriage 21 and pivot 13, hydraulic cylinder 19 remains at all times directly straight above the grinding wheel 15. Therefore, the contact force of the grinding wheel with the billet is determined directly by the pressure set in hydraulic cylinder 19. Therefore, by setting the pressure in hydraulic cylinder 19 and maintaining it constant, material is removed from the billet during the grinding process uniformly, irrespective of the position of the grinding wheel 15 relative to table 1.

Second Embodiment of the Invention

Figure 3:
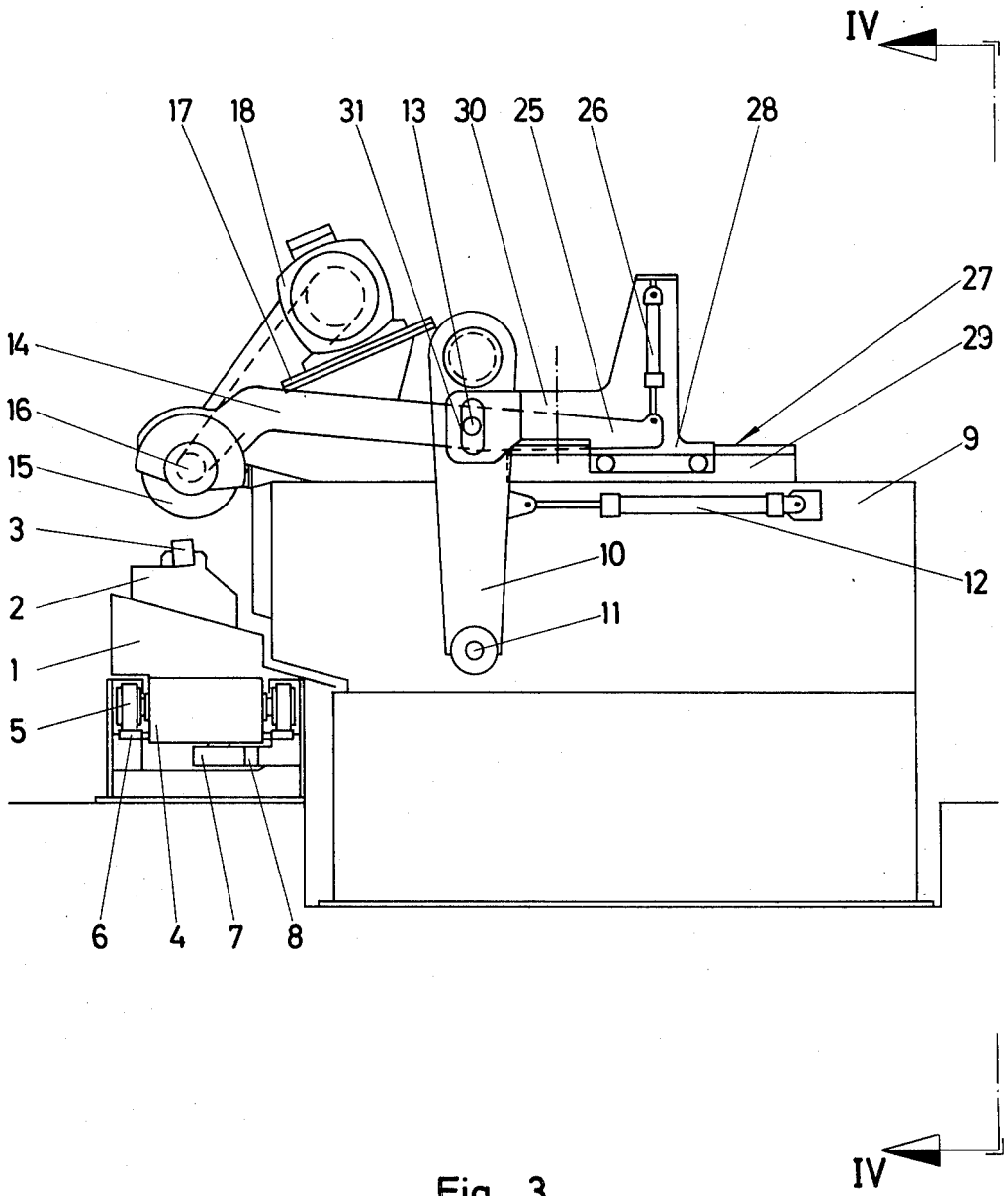
FIG. 3 illustrates a side-elevational view of a second embodiment of the present invention.
Figure 4:
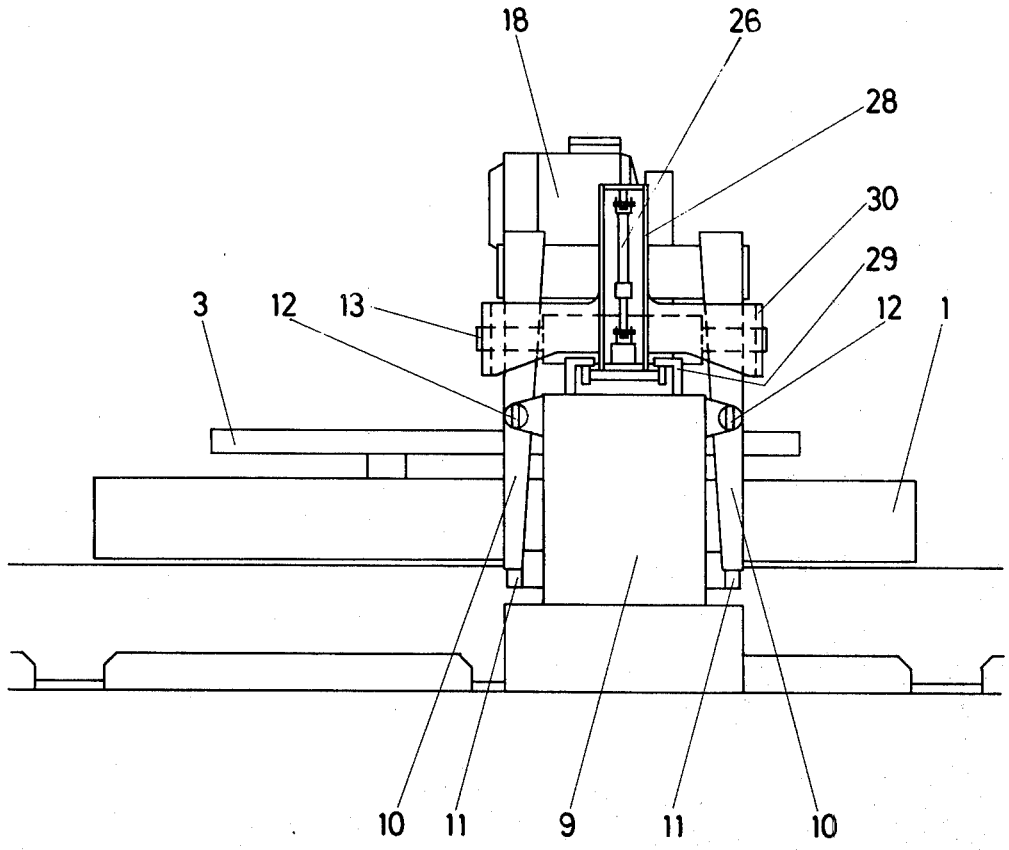
FIG. 4 is an end view showing the machine of FIG. 3 seen along Section IV—IV of FIG. 3.

In the second embodiment of the invention shown in FIGS. 3 and 4, the holder 14 extends beyond pivotal arms 10. This additional or rear portion 25 of the holder 14 is connected via a hydraulic cylinder 26 to a horizontal guide means 27 located in a direction perpendicular to the axle of the grinding wheel. The guide means 27 includes a carriage 28 adapted to move along horizontal tracks 29, which are rigidly connected to stand 9. The hydraulic cylinder 26 is arranged vertically and is pivotally connected to holder 14 and carriage 28. The carriage 28 is formed with coupling arms 30, which are provided with recesses 31, through which the arms 30 are coupled to pivot 13 on pivotal arms 10. The recesses 31 are formed as vertical slots so that the horizontal distance between pivot 13 and carriage 28 is maintained constant during the pivotal movement of pivotal arms 10.

During the grinding operation, the grinding wheel is moved into contact with the billet by means of the hydraulic cylinder 26, which acts on the rear portion of the holder 14. In this embodiment, holder 14 constitutes a lever, which is pivotal about pivot or joint 13. The contact force between grinding wheel 15 and billet 3 is determined by the pressure in hydraulic cylinder 26 and the ratio between the portions of holder 14 on each side of pivot 13. In this manner, the load of holder 14, including the weight of grinding wheel 15 and motor 18, is relieved to the extent desired. The hydraulic cylinder 12 operates via the pivotal arms 10 to move the grinding wheel 15 in a direction perpendicular to the direction of movement of the table 1. The hydraulic cylinder 26 acts upon the rear portion 25 of holder 14 at a substantially constant angle due to the coupling arms 30. As a result, a constant pressure in the hydraulic cylinder maintains a constant contact force between the grinding wheel and the billet 3. Thus, a uniform removal of material from the billet is obtained during the grinding process, irrespective of the position of the grinding wheel 15 in relation to table 1.

Third Embodiment of the Invention

Figure 5:
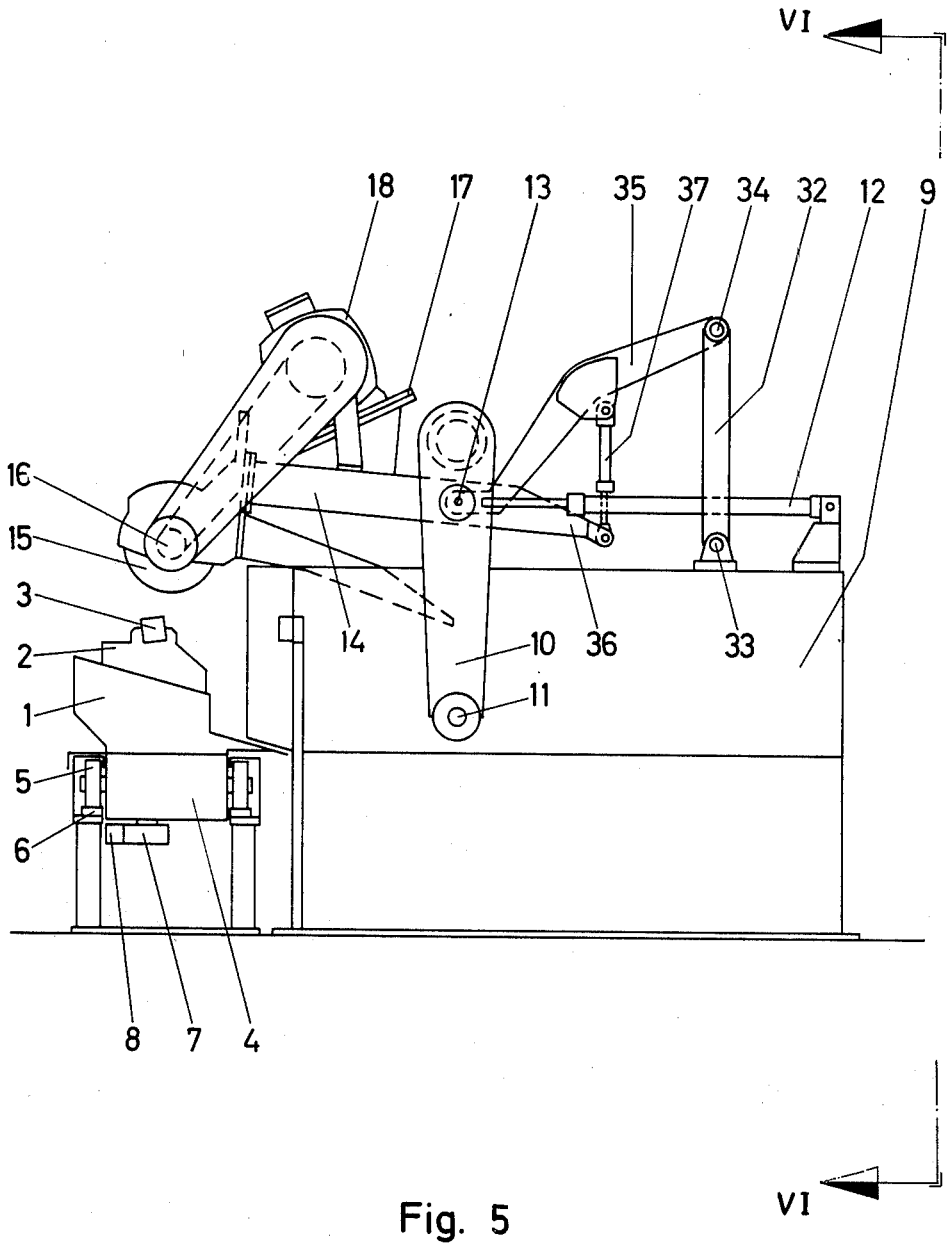
FIG. 5 is a side-elevational view of a third embodiment of the present invention.
Figure 6:
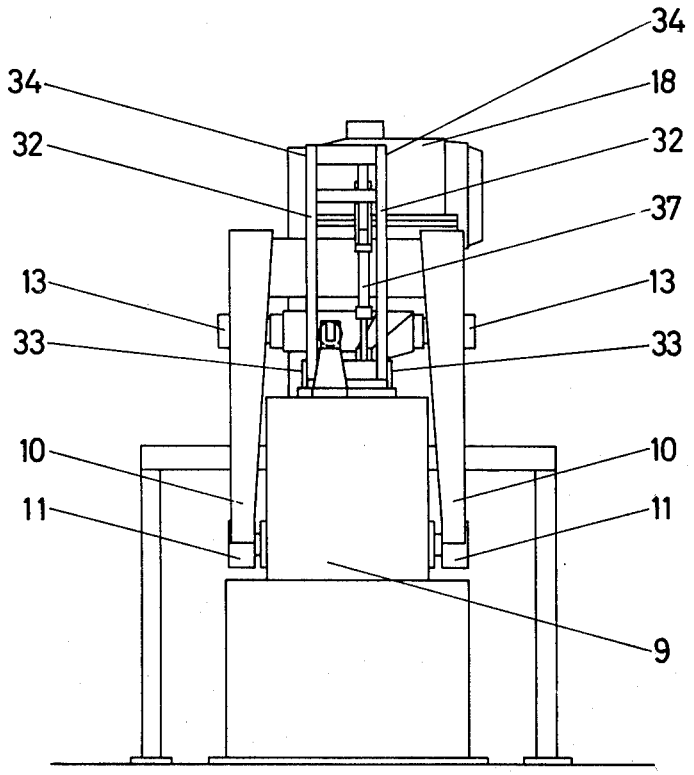
FIG. 6 is an end-elevational view of the machine of FIG. 5 seen along Section VI—VI of FIG. 5.

In the third embodiment of the invention shown in FIGS. 5 and 6, a rear pivotal arm 32 is provided in addition to the pivotal arms 10. This pivotal arm 32 is pivotally connected to a horizontal axle 33 mounted on stand 9 and is substantially in parallel with pivotal arms 10. Between pivot 13 and a pivot 34, located at the upper end of hinged arm 32, a coupling arm 35 is provided. The distance between the two pivots 33, 34 on pivotal arm 32 is the same as the distance between pivots 11, 13 on pivotal arms 10.

In addition, the holder 14 extends behond pivot 13 and forms a rear portion 36 of the holder, which is connected via a hydraulic cylinder 37 to the coupling arm 35. The hydraulic cylinder 37 is arranged substantially vertically and is pivotally connected at one end to rear portion 36 and at the other end to coupling arm 35. During movement of the pivotal arms 10, the rear pivotal arm 32, due to the coupling arm 35, moves in parallel with the pivotal arms 10. As a result, hydraulic cylinder 37 maintains its vertical position at all times and thereby acts upon the rear portion 36 of holder 14 at a substantially constant angle.

During the grinding operation, the grinding wheel is brought into contact with the billet by means of the hydraulic cylinder 37 which acts via the rear portion 36 of holder 14. The holder 14 thereby constitutes a lever pivotal about pivot 13. The contact force between grinding wheel 15 and billet 3 is determined by the pressure set in hydraulic cylinder 37 and the ratio between the lever portions of holder 14 on each side of pivot 13. In this manner, the load of holder 14, including the weight of grinding wheel 15 and motor 18, is relieved to the extent desired. The hydraulic cylinder 12 operates to move the pivotal arms 10 to move grinding wheel 15 in a direction transverse to the direction of movement of table 1. The hydraulic cylinder 37 acts upon the rear portion 36 of holder 14 at a substantially constant angle due to the rear pivotal arm 32 and the coupling arm 35. As a result, a constant pressure in hydraulic cylinder 37 results in a constant contact force between the grinding wheel and billet. Thus, a uniform removal of material from the billet is obtained during the grinding process, irrespective of the position of the grinding wheel 15 in relation to the table 1.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A grinding machine for grinding a workpiece such as an ingot or a billet comprising:

a movable table for supporting said workpiece;

a base and a pair of substantially vertical arms pivotally mounted on said base;

a grinding wheel for grinding the surface of said workpiece;

a holder for said grinding wheel pivotally connected to said pair of arms at a pivot so that the contact force of the grinding wheel with the workpiece is caused by the turning moment of said holder about said pivot;

a substantially vertically-acting hydraulic cylinder connected to said holder for pivoting said holder and said grinding wheel about said pivot and for counterbalancing the weight of said holder and said grinding wheel to control the contact force of said grinding wheel; and means for movably supporting said hydraulic cylinder and being connected to said pivot so that said hydraulic cylinder is movable with said holder as said holder moves about said pivot while maintaining its substantially-vertical position.

2. A grinding machine in accordance with claim 1, wherein said means for movably supporting said hydraulic cylinder includes a carriage movable along horizontal tracks, said carriage supporting said hydraulic cylinder, and a coupling arm connecting said carriage to said pivot so that said hydrulic cylinder is movable with said carriage along said horizontal tracks as said holder moves about said pivot.

3. A grinding machine in accordance with claim 2, wherein said coupling arm is pivotally connected to said carriage and to said pivot.

4. A grinding machine in accordance with claim 2, wherein said coupling arm is rigidly connected to said carriage and is coupled to said pivot by means including a vertically-disposed recess.

5. A grinding machine in accordance with claim 1, wherein said hydraulic cylinder is arranged directly above the axle of said grinding wheel.

6. A grinding machine in accordance with claim 1, wherein said hydraulic cylinder is located on the side of said pivot opposite from said grinding wheel.

7. A grindng machine in accordance with claim 1, wherein said holder extends between said grinding wheel and said pivot, and a portion of said holder extends beyond said pivot to define a rear portion of said holder, and said hydraulic cylinder being coupled to the rear portion of said holder.

8. A grinding machine in accordance with claim 7, wherein the means for movably supporting said hydraulic cylinder includes a coupling arm coupled to said pivot, a rear pivotal arm pivotally mounted on said base and being pivotally connected to said coupling arm, and said pair of arms and said rear pivotal arm being mounted in parallel and having lever portions of equal length.

* * * * *